United States Patent [19]

Hess et al.

[11] 4,237,656

[45] Dec. 9, 1980

[54] MOTOR VEHICLE WINDOW DRIVE MECHANISM

[75] Inventors: Hans-Peter Hess; Günther Mühling, both of Coburg; Manfred Sünkel, Sonnefeld; Hans Dauernheim, Dreieich, all of Fed. Rep. of Germany

[73] Assignee: Metallwerk Max Brose, GmbH, Coburg, Fed. Rep. of Germany

[21] Appl. No.: 31,519

[22] Filed: Apr. 19, 1979

[30] Foreign Application Priority Data

Apr. 25, 1978 [DE] Fed. Rep. of Germany ..... 2818109
Jul. 4, 1978 [DE] Fed. Rep. of Germany ..... 2829378

[51] Int. Cl.[3] ..... E05F 11/48
[52] U.S. Cl. ..... 49/352; 74/89.2
[58] Field of Search ..... 49/352, 325, 357; 74/89.2

[56] References Cited

U.S. PATENT DOCUMENTS 3,831,320 8/1974 Dauernheim ..... 49/352

FOREIGN PATENT DOCUMENTS 2656428 6/1978 Fed. Rep. of Germany ..... 49/352

*Primary Examiner*—Kenneth Downey
*Attorney, Agent, or Firm*—Toren, McGeady and Stanger

[57] ABSTRACT

A drive mechanism for the window of a motor vehicle includes a carriage having the window affixed thereto and a carrier attached to the carriage with a drive cable having the carrier fastened in driven engagement therewith. A guide tube made of plastic material surrounds the drive cable and a support tube surrounds the guide tube. Both the support tube and the guide tube are formed with a longitudinal slot through which a portion of the carrier may extend in order to effect the driven engagement between the drive cable and the carrier.

20 Claims, 10 Drawing Figures

MOTOR VEHICLE WINDOW DRIVE MECHANISM

BACKGROUND OF THE INVENTION

The present invention relates to a mechanism for driving the window of a motor vehicle. More specifically, the invention relates to the type of window drive mechanism wherein a drive cable which extends in the direction of movement of the window is arranged in driving engagement with a carrier or engaging member to effect the desired window driving operation. The drive cable is surrounded by a guide tube which has a longitudinal slot therein through which the carrier member extends into engagement with the drive cable.

A window drive mechanism of the type referred to herein is known from German Pat. No. 1,555,632. In this window lifting mechanism, the guide tube is formed of metal. Furthermore, in accordance with German Pat. No. 1,196,095 it is known to produce the guide tube of such a window drive mechanism from plastic material.

The present invention is directed toward the task of providing a window drive mechanism of the aforementioned type wherein the guide tube may be made entirely of plastic material and wherein it is possible to avoid that the drive cable can be pulled out of the guide tube in the region of the slot.

SUMMARY OF THE INVENTION

Briefly, the present invention may be described as a drive mechanism particularly for the window assembly of a motor vehicle having means defining a window aperture with a window adapted to be lifted and lowered through the aperture, the drive mechanism comprising a carriage having the window affixed thereto, a carrier attached to the carriage, a drive cable fastened to the carrier in order to effect driving movement of the window, a guide tube surrounding the cable and a support tube surrounding the guide tube. The guide tube and the support tube are both formed with aligned longitudinal slots through which the drive cable may be connected with the carrier. The guide tube may be made entirely of plastic material and it will extend in a direction parallel to the driving direction of the window.

In accordance with the present invention, disadvantages of the prior art are overcome in that the window drive mechanism is particularly characterized by the fact that the guide tube consists of plastic material and that the support tube with the longitudinal slot is also provided, the support tube surrounding the guide tube with the longitudinal slot of the support tube being in alignment with the longitudinal slot of the guide tube.

Due to the fact that the support tube surrounds the guide tube, the guide tube cannot expand and the drive cable is thus prevented from escaping from the interior of the guide tube through the longitudinal slot. Such dislodgement of the cable could otherwise occur when the window drive mechanism is mounted in the door of a motor vehicle and when the door of the motor vehicle is suddenly moved or slammed in the direction of the slot.

In order to avoid axial shifting or rotation of the guide tube, means are provided on the guide tube whereby the guide tube will be supported in fixed engagement with at least one fastening member which locks the guide tube against shifting and/or rotation. Such means may preferably comprise at least one radial projection and/or at least one radial recess forming the connection with the fastening member.

In order to effect guided movement of the carrier with as little friction as possible in the region of the slot formed in the guide tube, the window drive mechanism is preferably formed so that from the edges of the slot in the guide tube there will extend a pair of arms formed as radial projections which rest against the edges of the slot in the support tube. As a result, the carrier need only contact the plastic surfaces of the guide tube.

One approach which is especially advantageous for the purpose of locking the guide tube against rotation involves the provision of two pairs of diametrically opposed arms formed as radial projections. If it is desired to increase the stiffness of the guide tube, more than a pair of such arms may be provided. In order to ensure that the drive cable moves within the guide tube with as little friction as possible, the guide tube is preferably formed to define therein lubrication pockets or indentations which are separated from each other by projections or beads.

In order to enhance the concentricity of the drive cable relative to the guide tube, the guide tube is preferably provided with support fins or ribs for the drive cable.

Of course, both lubrication pockets as well as support fins may be provided.

Since it may become necessary to stiffen the guide tube, in view of the fact that it is formed of plastic material, the wall of the guide tube is preferably formed with at least one stiffening wire embedded therein.

The forces which must be absorbed by the support tube portion are not necessarily significant. Accordingly, in special embodiments, the support tube portion may preferably consist of plastic material.

In order to guide the window lifting carriage so that it is prevented from tilting, the support tube portion is preferably formed as part of a guide bar having a ledge which extends parallel to the support tube portion. This ledge is provided with a leg which is surrounded by slide members on the lifting carriage and it operates to guide the lifting carriage in the desired direction of movement. The arrangement is such that the window is restrained from undesired movement in all directions extending transversely to the desired direction of its operating movement.

In order to provide the capability for selectively limiting the lifting movement of the window and, in order also to enable selective mounting of a guide bar, a row of holes are arranged in the ledge for selectively fastening the guide bar to a part which is rigid on the window frame and also to selectively fasten at least one stop member for limiting window movement.

In order to facilitate production of the device, it is advantageous to provide the arms mentioned above so that they extend along the entire length of the guide tube. In order to ensure that the drive cable extends outside of the region of the longitudinal slot in a closed guide tube, in the region outside of the slot the guide tube is preferably closed by means of a web which bridges the two radially inner ends of the arms.

The drive cable is driven in a manner known per se by a drive mechanism which may, for example, be the pinion of a drive mechanism, which pinion engages external teeth on the drive cable. Additionally, the drive cable may also be pretensioned in a manner known per se in the direction in which the window is lowered. For this purpose, there may preferably be provided a drive and/or tensioning device for the drive cable with a support member for the guide tube, the guide tube extending through this drive and/or tensioning device and the support member being in locked engagement with the guide tube.

In order to enable production of the support tube portion at the same time as the guide tube, and to extend the support tube portion along the entire length of the guide tube so that support for the guide tube will be provided along its entire length, the support tube portion is preferably embedded, and particularly injected, in plastic material. Such a support tube portion can be placed in the guide tube at the same time that the guide tube is made.

In a preferred embodiment of the window lifting mechanism in accordance with the present invention, the tube is provided on the exterior thereof with at least one radial projection which is in locking engagement with at least one fastening member which locks the guide tube against the shifting or rotating. In the region of such a radial projection, the support tube portion is preferably interrupted in order to facilitate insertion of the support tube portion into the guide tube.

The support tube may consist of foil material or also of a fabric. The preferred materials are aluminum or steel.

In a preferred embodiment, support fins for the drive cable are provided in the guide tube. A hard plastic is not especially suitable for the support fins because hard plastic is subject to high abrasion and will cause higher friction. Accordingly, the support fins are preferably formed to consist of a plastic which is softer than the plastic of the guide tube. The plastic for the support fins may be different from the plastic utilized in forming the support tube. For example, the support fins may preferably consist of polyurethane and the guide tube may preferably consist of hard polyvinylchloride. However, the support fins may also be made of plastic of the same type as the plastic of the guide tube when the plastic of the support fins is of a lesser hardness than the plastic of the guide tube.

In order to improve adhesion of the support tube portion onto the plastic material of the guide tube, the support tube is preferably coated with a lacquer to which the plastic material will adhere.

The various features of novelty which characterize the invention may be pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENTS

Figure 1:
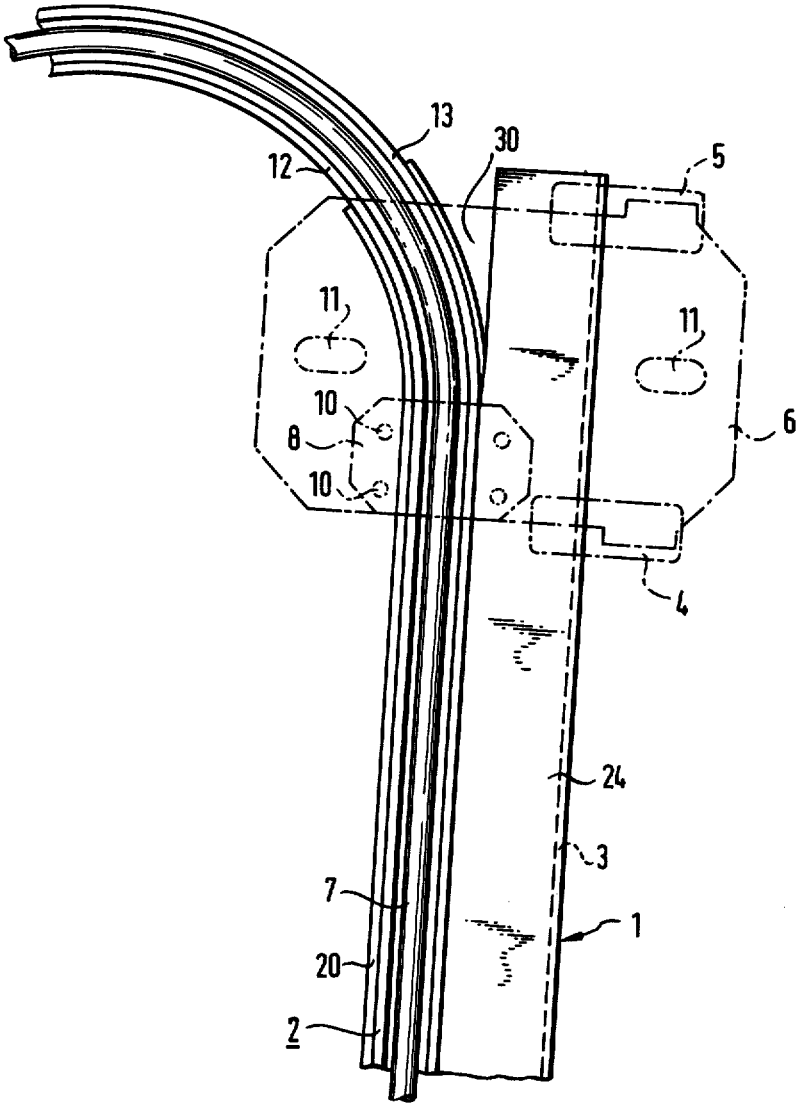
FIG. 1 is a schematic side elevation, partially in section, showing a portion of a window lifting mechanism in the upper region of the guide bar.
Figure 2:
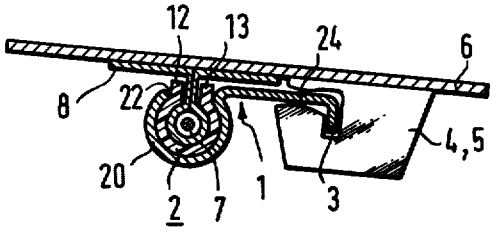
FIG. 2 is a sectional view taken from the bottom of the guide bar shown in FIG. 1.

Referring now to the drawing, wherein similar parts are referred to with like reference numerals throughout the various figures thereof, a window lifting mechanism in accordance with the present invention is depicted as comprising a guide bar 1 which is arranged beneath a window aperture and which extends parallel to the lifting direction of the window pane. A drive cable 7 is provided for lifting and lowering the window pane. In the drawings, the drive cable is indicated merely by discontinuous lines. The drive cable 7 is surrounded by a guide tube 2 which is mounted to the guide bar 1 and which is formed with a longitudinal slot extending in the region of the guide bar, the slot being defined by the arms 12, 13 as best seen in FIG. 2.

A carrier member 8 is fastened to the drive cable in driven engagement therewith. The carrier 8 includes a portion thereof which extends through the slot defined between the arms 12 and 13. Furthermore, the carrier 8 is fastened at points 10 to a lifting carriage 16 which bears the window pane, the carriage being guided on the guide bar 1. Fastening points 11, which are only schematically shown, operate to connect the lifting carriage 6 to the window pane (not shown). The lifting carriage 6 is provided with slide members 4 and 5 which are fastened thereon in order to provide guided movement of the carriage. The slide members 4 and 5 are arranged to have a leg 3 of the guide bar 1 in sliding engagement therewith, the engagement between the leg 3 and the slide members 4 and 5 being such that the lifting carriage is guided for movement in the desired direction of the window pane and such that undersired displacement in directions extending transversely to the direction of movement of the pane or perpendicularly to the plane of the pane are avoided.

The guide tube 2 consists of plastic material along its entire length. The guide bar 1 has a support tube 20 formed with a longitudinal slot 22 which is arranged in alignment with the longitudinal slot in the guide tube 2 which is defined between the arms 12 and 13. The support tube portion 20 surrounds the guide tube 2 and the arms 12 and 13 extend radially outwardly through the slot 22 and are arranged to rest against the edges of the support tube 20 which define therebetween the slot 22.

The guide bar 1 is provided with a bulge or flange 24 which extends parallel to the support tube 20 and which has a row of holes 16 formed therein. Rivets 26 which are passed through the holes 16 at selected points of the guide bar 1 operate to mount thereon a fastening lug 19 having a countersunk fastening nut 28 which may be utilized for attachment to a sheet metal part of the inner side of a motor vehicle door. The fastening lug 19 is passed through one of a row of slots 17 formed in the ledge 24.

Figure 3:
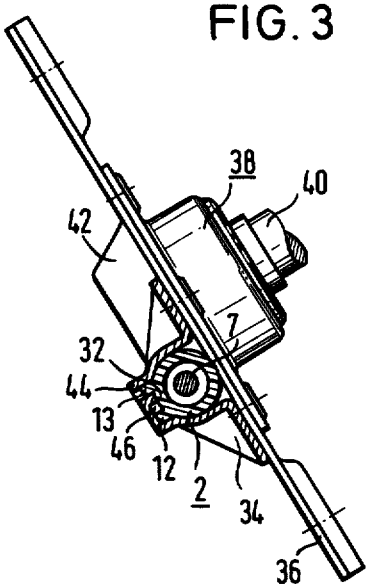
FIG. 3 is a schematic view partially in section showing the guide tube of the window lifting mechanism in the region of the drive mechanism.
Figure 4:
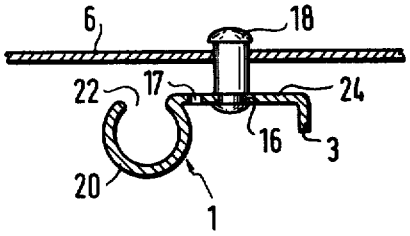
FIG. 4 is a sectional view of the guide bar depicting a limiting stop member.
Figure 5:
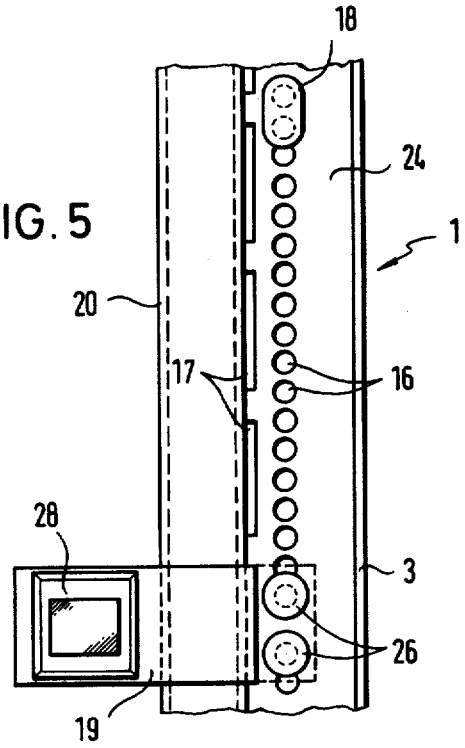
FIG. 5 is a side elevation of a portion of the guide bar showing a row of fastening holes.
Figure 6:
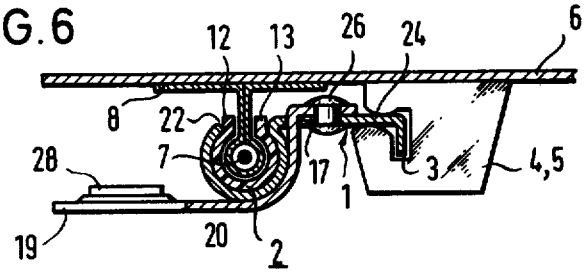
FIG. 6 is a sectional view showing the bottom of the guide bar of FIG. 5.

At the upper end of the guide bar 1, the support tube 20 is separated and bent from the ledge or flange 24 by means of an incision 30 in order to surround and support the guide tube 2 along its path to the drive mechanism. As will be seen from FIG. 3, on the outside of the slot defined between the arms 12 and 13, the guide bar 2 is closed by a web 32 which connects the two radially inner ends of the arms 12,13. In FIG. 3, the guide tube 2 is shown disposed in a support member 34 by means of which the guide tube 2 is fastened to a base plate 36 of a drive mechanism 38 in order to prevent turning or rotation thereof and in order to provide a firm mounting arrangement. To prevent axial shifting of the guide tube 2 by the support member 34, the support member is formed with a projection 44 which engages a recess 46 of the arm 13. The drive mechanism 38 has a drive shaft 40 which includes a pinion (not shown) which projects outwardly from a housing cover 42. This pinion extends through a lateral slot in the guide tube 2 in order thereby to engage teeth formed on the drive cable 7, in a manner known per se.

Between the guide bar 1 and the drive mechanism 38, the guide tube 2 may be fastened by means of clips which will secure the guide tube 2 against rotation and/or against axial shifting in a firm and positive manner, for example, on the inner sheet metal door of the motor vehicle, this fastening arrangement not being shown in the drawing.

Figure 7:
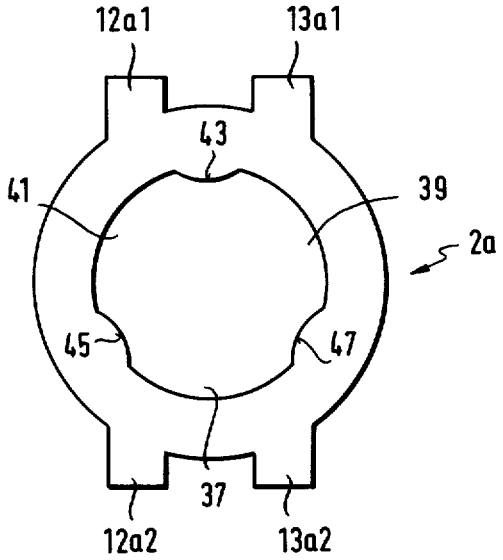
FIG. 7 is a cross-sectional view of another embodiment of the guide tube.

FIG. 7 shows a guide tube **2*a* which has radial projections extending therefrom as two pairs of diametrically opposed arms 12*a*1, 13*a*1, 12*a*2,13*a*2. Lubrication reliefs or pockets 37,39 and 41 for the drive cable 7 are provided between radially extending beads or protuberances 43,45 and 47 formed in the guide tube 2*a***.

Figure 8:
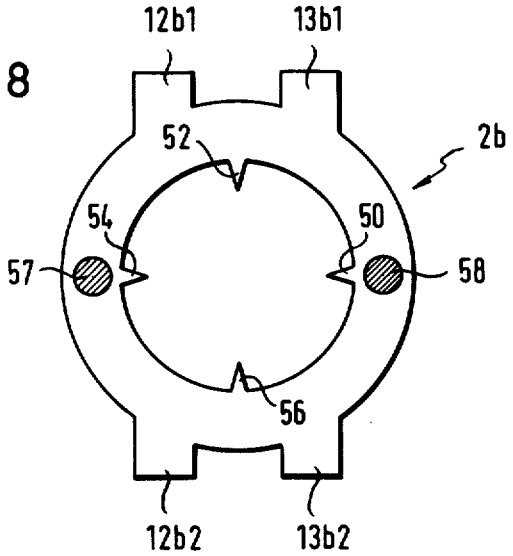
FIG. 8 is a cross-sectional view of a third embodiment of the guide tube.

A guide tube **2*b* shown in FIG. 8 is also formed with radial projections comprising two pairs of diametrically opposed arms 12*b*1, 13*b*1, 12*b*2, 13*b*2. In order to center and support the drive cable 7, the guide tube 2 is formed with support fins 50,52,54,56 which are located in pairs opposite each other. Between the two pairs of arms where the guide tube 2*b* is softest, stiffening wires 57,58 are provided in the wall of the tube 2*b***.

Figure 9:
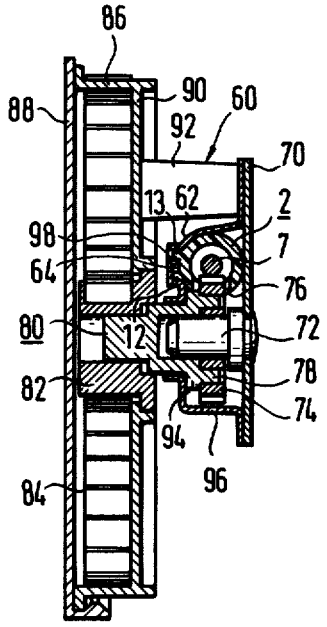
FIG. 9 is a sectional view showing a tensioning device for the drive cable located in the guide tube.

Shown in FIG. 9 is a device which operates to tension the drive cable 7 in the guide tube 2. This device may also be combined with the drive mechanism shown in accordance with FIG. 3. In FIG. 9, a stepped bolt 72 is riveted to a base plate 70. The bolt 72 serves as a bearing for a pinion 74 which engages the external teeth on the drive cable by extending through a cutout 76 formed in the guide tube 2. A carrier 80 engages the pinion 74 with projections 78, the free end of the carrier 80 being connected in a locked manner to a hub 82 of a flat spiral spring 84. The outer end of the spiral spring 84 is hooked into a circumferential wall 86 of a housing formed by the wall 86 and the walls 88 and 90. The housing is fastened to the base plate 70 through spacers 92 and the guide tube 2 and a step 94 of the carrier 80 surrounded by a support stirrup 96 having ends which are fastened to the base plate 70.

As in the drive mechanism shown in FIG. 3, the arm 13 of the guide tube 2 is formed in the region of the support stirrup 96 with a recess in which there is engaged a projection 98 of the holding stirrup 96.

Figure 10:
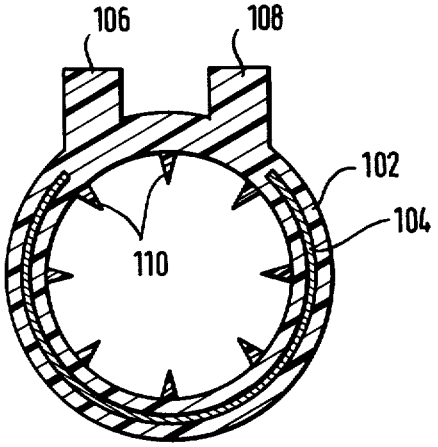
FIG. 10 is a cross-sectional view of a fourth embodiment of the guide tube.

FIG. 10 shows another guide tube 102 made of plastic material within which there is embedded a support tube section 104. Two adjacent arms 106,108 project as radial projections from the guide tube 102 and in the region of the arms 106,108, the support tube section is discontinued. Support fins 110 for the drive cable are provided in the guide tube, these support fins consisting of plastic material which is softer than the plastic material from which the guide tube 102 is formed.

While specific embodiments of the invention have been shown and described in detail to illustrate the application of the inventive principles, it will be understood that the invention may be embodied otherwise without departing from such principles.

What is claimed is:

1. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said longitudinal slot in said guide tube being formed between a pair of radial projections with said another slot in said support tube being formed between a pair of longitudinal edges of said support tube, said radial projections of said guide tube extending to between said edges of said support tube.

2. A mechanism according to claim 1 wherein said support tube consists essentially of plastic material.

3. A mechanism according to claim 1 further comprising driving and tensioning means for said drive cable including a support member for said guide tube which is in locked engagement with said guide tube, said driving and tensioning means extending through said guide tube.

4. A mechanism according to claim 1 wherein said support tube is embedded in said plastic material forming said guide tube.

5. A mechanism according to claim 1 wherein said support tube consists of solid material.

6. A mechanism according to claim 1 wherein said support tube consists of fabric.

7. A mechanism according to claim 1 wherein said support tube consists of one of the materials aluminum and steel.

8. A mechanism according to claim 1 wherein said support tube is coated with a lacquer for causing plastic material of said guide tube to adhere thereto.

9. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, a support tube surrounding said guide tube and provided with another longitudinal slot which extends in alignment with said longitudinal slot in said guide tube, said support tube being arranged to deter said drive cable being displaced from within said guide tube through said longitudinal slot, and means for mounting said guide tube in a fixed manner to prevent rotation and shifting thereof, said guide tube having formed on the outer surface thereof two pairs of diametrically opposed arms extending as radial projections therefrom.

10. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said guide tube being formed on the interior thereof with lubrication pockets each separated from an adjacent lubrication pocket by inner protuberances, said lubrication pockets being provided to facilitate lubrication of movement of said drive cable within said guide tube.

11. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, a support tube surrounding said guide tube and provided with another longitudinal slot which extends in alignment with said longitudinal slot in said guide tube, said support tube being arranged to deter said drive cable being displaced from within said guide tube through said longitudinal slot, and radially inwardly extending support fins provided on the interior of said guide tube for guiding movement of said drive cable therein.

12. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said guide tube being constructed with wall portions thereof having stiffening wire means embedded therein.

13. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said support tube being formed as part of a longitudinal guide bar which includes a flange portion extending radially and longitudinally relative to said support tube, said flange portion including a leg extending therefrom, said mechanism further comprising slide members mounted on said carriage, said slide members being in sliding guided engagement with said leg of said guide bar to restrain movement of said carriage in all directions extending transversely to the direction of movement of said window pane.

14. A mechanism according to claim 13 wherein said flange member is formed with a row of holes extending therethrough in order to enable selective fastening of said guide bar upon said vehicle and in order to provide for fastening to said guide bar of at least one stop member limiting the extent of movement of said window pane.

15. A mechanism according to claims 13 or 12 wherein, at an upper end of said guide bar, said support tube is separated from said flange member by means of an incision and is bent in order to provide a curved path for said guide tube.

16. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said guide tube being provided on the outside thereof with at least one radial projection which is in locking engagement with at least one fastening member which secures said guide tube against displacement and rotation, said support tube being discontinuous in the region of said radial projection.

17. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said guide tube being provided with support fins for said drive cable, said support fins consisting of plastic material which is softer than the plastic material of said guide tube.

18. A mechanism according to claim 17 wherein said support fins consist of polyurethane and wherein said guide tube consists of hard polyvinylchloride.

19. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, and a support tube surrounding said guide tube and provided with another longitudinal slot which extends in alignment with said longitudinal slot in said guide tube, said support tube being arranged to deter said drive cable being displaced from within said guide tube through said longitudinal slot, said guide tube being provided with support fins for said drive cable, said support fins consisting of a plastic material which is of the same type as the plastic material of said guide tube but which has been hardened to a lesser degree than the plastic material of said guide tube.

20. A window drive mechanism, particularly for lifting and lowering a motor vehicle window pane comprising a carriage adapted to have said window pane affixed thereto, a drive cable for operatively driving said carriage, a guide tube consisting essentially of plastic material extending in a direction parallel to the driven direction of said carriage, said tube being arranged to surround said drive cable and having said cable operatively arranged in guided engagement therein, means on said guide tube defining a longitudinal slot therethrough, said carriage having a portion thereof extending through said longitudinal slot and connected with said drive cable for effecting driven engagement between said drive cable and said carriage, a support tube surrounding said guide tube and provided with another longitudinal slot which extends in alignment with said longitudinal slot in said guide tube, said support tube being arranged to deter said drive cable being displaced from within said guide tube through said longitudinal slot, and guide rail means affixed to said guide tube and extending parallel thereto and to the driven direction of said carriage and having said carriage in guided engagement therewith, said support tube and said guide rail means both being formed of the same metallic sheet material.

* * * * *